United States Patent [19]

Minks

[11] 4,323,869

[45] Apr. 6, 1982

[54] ARMATURE MOUNT FOR AN ELECTROMAGNETIC RELAY

[75] Inventor: Werner Minks, Kleingeschaidt, Fed. Rep. of Germany

[73] Assignee: ITT Industries, Inc., New York, N.Y.

[21] Appl. No.: 157,164

[22] Filed: Jun. 6, 1980

[30] Foreign Application Priority Data

Jun. 15, 1979 [DE] Fed. Rep. of Germany ..... 2924263

[51] Int. Cl.[3] ..... H01H 51/08; H01F 7/08

[52] U.S. Cl. ..... 335/274; 335/128; 335/192

[58] Field of Search ..... 335/274, 275, 276, 128, 335/192, 269

[56] References Cited

U.S. PATENT DOCUMENTS 2,735,968 2/1956 Bogue et al. ..... 335/275

3,474,367 10/1969 Zupa ..... 335/274

FOREIGN PATENT DOCUMENTS 1153960 6/1969 United Kingdom ..... 335/274

*Primary Examiner*—Harold Broome

*Attorney, Agent, or Firm*—James B. Raden; William J. Michals

[57] ABSTRACT

The relay includes an "L"-shaped yoke and a cylindrical solenoid core mounted at end thereof in a hole in the short arm of the yoke. The other end of the core is terminated in a pole plate which engages one leg of an angle armature which is pivotally mounted at the end of the long arm of the yoke. The other leg of the angle armature is biased toward the long arm of the yoke by a flat leaf spring. The spring is mounted at one end thereof to the long arm of the yoke and includes a free end which projects through a slot in the other end of the angle armature for engaging a flattened portion of the angle armature at the apex edge of the angle armature. Upon deactivation of the relay, the angle armature is swivelled away from the pole plate until the flat spring is flatly applied to the flattened portion of the angle armature, thereby defining the deactivated end position of the armature.

5 Claims, 3 Drawing Figures

ARMATURE MOUNT FOR AN ELECTROMAGNETIC RELAY

BACKGROUND OF THE INVENTION

The present invention relates to an armature mount for an angle armature supported on the yoke's edge, which is retained in position by a flat spring secured on the yoke and which, towards the yoke's end is bent off the yoke and, with its free end, presses from the outside against the angular edge of the armature.

With regard to electromagnetic relays it is known to retain the angle armature in its position with the aid of a spring. In various types of embodiment, however, this spring has a complicated shape so that its manufacture involves a considerable investment (U.S. Pat. No. 3,474,367, German Petty Patent (DE-GM) No. 1,981,929).

Some types of electromagnetic relays are known in which the armature retention spring for the angle armature has a relatively simple shape (German Offenlegungsschrift (DE-OS) No. 2,020,150, German Auslegeschrift (DE-AS) No. 1,292,752). In these conventional types of embodiment the armature retention spring exerts a pressure on the angle armature opposite the yoke's edge. For this purpose the armature retention spring is required to be strongly bent, with this requiring relatively much space in the relay. Moreover, in these conventional types of embodiment no torque at all is exerted upon the angle armature by the armature retention spring.

It is the object of the invention to provide a simple armature mount for an angle armature comprising a flat spring, which requires relatively little space in the relay and by which, in the attracted state of the armature, a slight but defined torque is exerted upon the angle armature.

SUMMARY OF THE INVENTION

With regard to an armature mount of the type mentioned hereinbefore, this object is achieved in that the straight, free end of the flat spring is applied areally to a flattened part of the angular edge of the armature, when said armature is in its end position in which it is lifted off the core.

By flatly applying the armature retention spring to the angular edge of the armature, it is made possible to design the spring in such a way as to require only very little space therefor, and by causing the straight, free end of the flat spring to cooperate with the flattened part of the angular edge of the armature it is achieved that a slight defined torque is exerted on the armature when in its attracted state. Upon dropping of the angle armature, and caused by the flat spring end interacting with the flattened part, there is produced a locking effect so that the angle armature is retained in a defined end position in the dropped off state. The torque exerted upon the angle armature can be easily maintained reproducibly also during mass production, because it depends principally on the angle of the bent spring and on the chamfering angle of the angle armature.

Considering that the spring only consists of straight parts which are angled off with respect to one another, it is easy to be made to have a defined spring force.

It is of advantage to design the armature retention spring to have a reduced width in its part resting on the angle armature and to let the flattened part of the angle armature extend correspondingly only throughout a portion of the width thereof. In so doing, there is obtained an additional guidance for the angle armature by the armature retention spring, thus preventing the angle armature from becoming twisted.

Moreover, for the sake of obtaining a soft spring action and a minimum overall height, the angle armature is provided with a slot through which the armature retention spring is permitted to project.

BRIEF DESCRIPTION OF THE DRAWING

The invention will now be explained in greater detail with reference to FIGS. 1 to 3 of the accompanying drawings, of which FIGS. 1 and 2 schematically show the arrangement of the angle armature with respect to both the yoke and the core, and in which in particular:

The angle armature 4 is pivotally mounted on the edge 5 of the yoke 1. The contact actuating member 6 serves to actuate the relay contacts when the angle armature is moved about the yoke edge 5. The angle armature 4 is retained in its position by the armature retention spring 7. This armature retention spring 7 is a flat (leaf) spring which is mounted at point 8 to the yoke 1 and rests with its following part on the yoke 1. At the points indicated by the reference numerals 11, the armature retention spring 7 is bent off three times at an obtuse angle, and the free, straight-lined end 9 rests on the angular edge of the armature 4. At this particular point the armature is provided with a flattened part 10 as is evident in particular from FIG. 2. Both the flattened part 10 of the angle armature 4 and the free end 9 of the flat spring 7 extend in such a direction and occupy such a position that in the deenergized state as shown in FIG. 1, the free end 9 of the flat spring 7 will come to lie flat on the flattened part 10 of the angle armature 4. FIG. 1 permits to recognize that the one leg of the angle armature 4 is at a certain spaced relation from the pole plate 3 as attached to the core 2. The coil arranged on the core has been omitted in the drawings for the sake of clarity.

Figure 2:
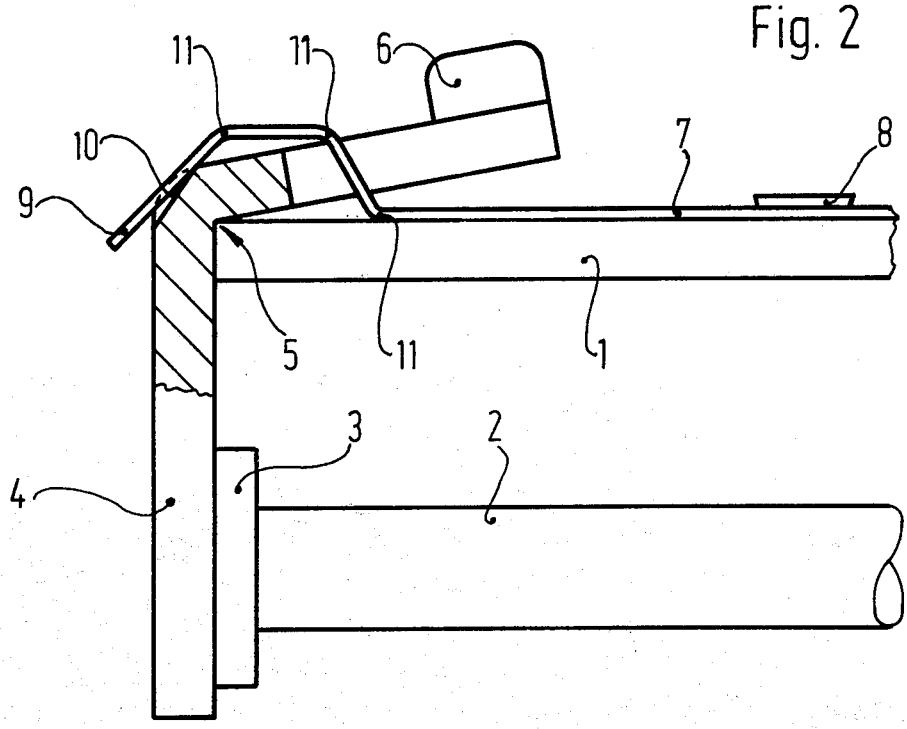
FIG. 2 shows the angle armature in the attracted state.

In the attracted state, as is shown in FIG. 2, the angle armature 4 either with or without an airgap, is applied to the pole plate 3 of the core 2 and the corresponding relay contacts are actuated in response to the movement of the contact actuating member 6. In this state the free end 9 of the flat spring 7 no longer rests flatly on the flattened part 10, but on the one edge of the flattened part 10. In this way a small but defined torque is exerted upon the angle armature 4.

Figure 1:
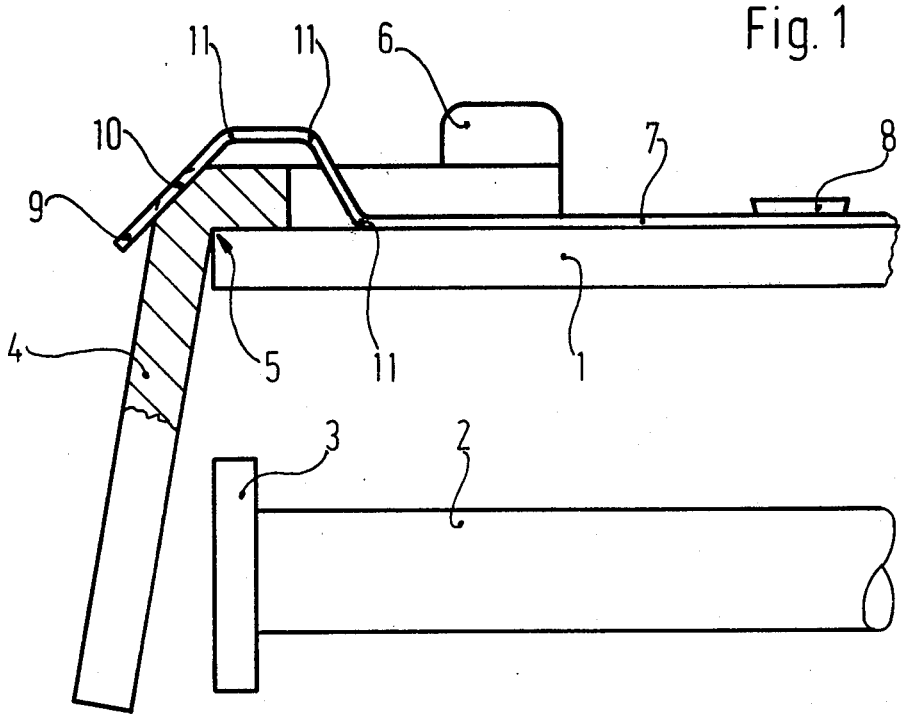
FIG. 1 shows the angle armature in the deenergized state.

Upon deenergization of the coil arranged on the core 2, the armature 4 is swivelled back into its original position as shown in FIG. 1, by the slight troque exerted thereupon by the end 9 of the flat spring 7, until reaching a defined end position when the free end 9 of the flat spring 7 is flatly applied to the flattened part 10.

Considering that the armature retention spring 7 only consists of angularly bent straight parts, it can be very easily manufactured with a defined spring force, and only requires very little space in the relay. Therefore, the armature mount according to the invention is particularly suitable for the use with miniature relays.

Figure 3:
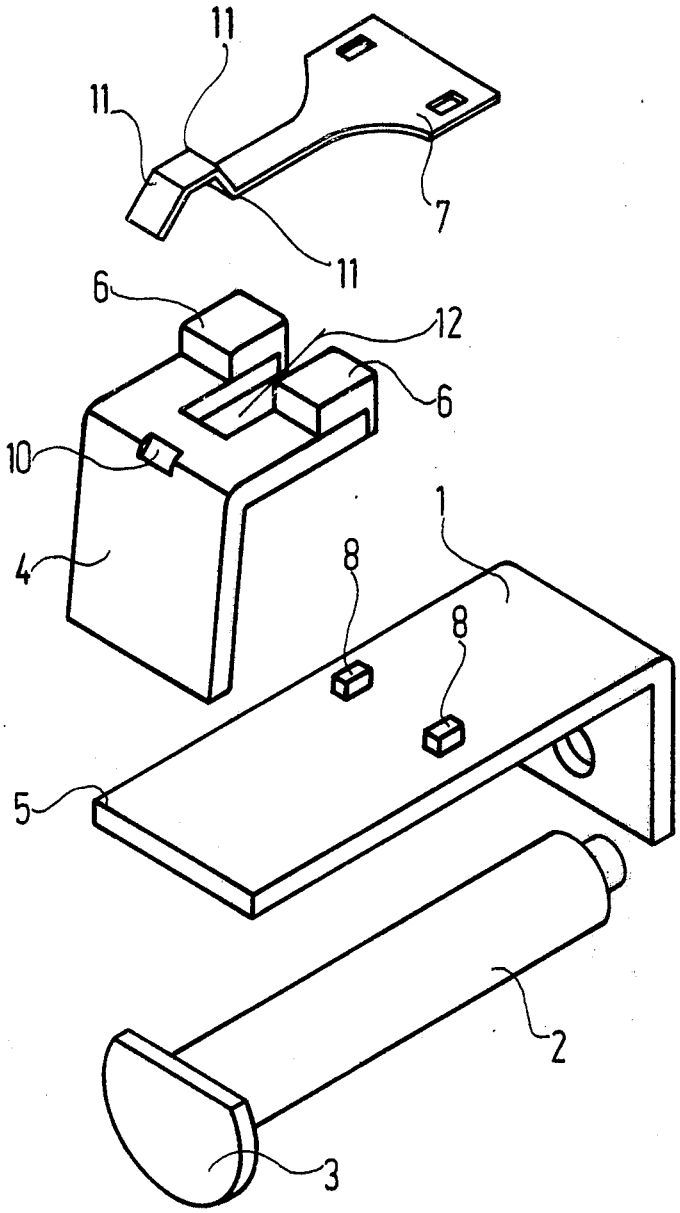
FIG. 3 shows parts of the magnet system as well as the armature retention spring, perspectively in an exploded view.

FIG. 3 shows the individual parts of the magnet system as well as the armature retention spring perspectively in an exploded view. As will be seen from this drawing, the armature retention spring 7 is tapered towards its free end, so that the part provided with the angled-off portions 11, which rests with its end on the angle armature, has a smaller width than the end mounted to the yoke 1. The angle armature 4 is provided with a slot 12 through which, in the assembled state, the free end of the armature retention spring 7 is permitted to project. The flattened part 10 of the angle armature 4 is only designed to have such a width as to correspond to the width of the free end of the armature retention spring 7. In this way there is achieved an additional guidance for the angle armature by the armature retention spring, preventing the angle armature from becoming subjected to a lateral twist.

In the assembled state, the core 2 with its pins lying opposite the pole plate 3, is mounted in the hole of the yoke 1, and the armature retention spring 7 is placed with its recesses on to the mounting studs of the yoke 1, and is secured thereto by way of upsetting. The angle armature 4 rests on the yoke's edge 5, and the free end of the armature retention spring 7 projects through the slot 12 as provided for in the angle armature, and thus rests on the flattened part 10 of the angle armature 10. This results in a very good guidance of the angle armature 4 on the edge 5 of the yoke 1, and the overall height of the relay is kept at a very low level.

What is claimed is:

1. An armature mount for an electromagnetic relay having a yoke and core comprising an angle armature supported on the yoke's edge, which is retained in position by a flat spring secured on the yoke and which, towards the yoke's end, is bent off the yoke and, with its free end, presses from the outside against the angular edge of the armature, wherein the straight, free end of the flat spring is applied areally to a flattened part of the angular edge of the armature when said armature is in its end position in which it is lifted off the core, wherein said flat spring following the mounting point is applied with a portion of its length to the yoke and is provided with three obtuse-angled bends at is free end, and wherein the first bend extends angularly away from said yoke and said armature and joins the second bend which extends generally parallel to said yoke toward said end of said yoke and joins the third bend which extends angularly toward said armature for engaging said angular edge of said armature.

2. The armature mount as claimed in claim 1, wherein said flat spring almost has the width of said yoke and is tapered at its free end to a portion of this width.

3. The armature mount as claimed in claim 2, wherein said flattened part of said angle armature only extends to a portion of the width thereof.

4. The armature mount as claimed in claim 3, wherein said flattened part of said angle armature is of the same width as the free end of said armature retention spring.

5. The armature mount as claimed in claim 4, wherein the leg of said angle armature which extends approximately in parallel with said yoke is provided with a slot through which said armature retention spring is permitted to project.

* * * * *